United States Patent [19]

Harvey

[11] 4,036,169

[45] July 19, 1977

[54] APPARATUS FOR COATING ARTICLES

[75] Inventor: Peter Harvey, London, England

[73] Assignee: MacPherson Powders Limited, England

[21] Appl. No.: 602,512

[22] Filed: Aug. 7, 1975

Related U.S. Application Data

[62] Division of Ser. No. 463,580, April 24, 1974, abandoned.

[51] Int. Cl.[2] ..... B05C 19/00

[52] U.S. Cl. ..... 118/66; 118/304; 118/243; 118/308; 118/317; 118/421

[58] Field of Search ..... 118/243, 263, 13, 421, 118/DIG. 5, 304, 306, 308, 317, 426, 66

[56] References Cited

U.S. PATENT DOCUMENTS

| | | | |
|---|---|---|---|
| 561,141 | 6/1896 | Smyser | 118/243 X |
| 2,739,424 | 3/1956 | Fritze | 118/306 X |
| 3,108,537 | 10/1963 | Way et al. | 118/243 X |
| 3,355,310 | 11/1967 | DeJean et al. | 118/317 X |
| 3,431,887 | 3/1969 | Pettigrew et al. | 118/DIG. 5 |
| 3,503,435 | 3/1970 | Dunlop | 118/426 X |
| 3,875,898 | 4/1975 | Braden | 118/421 |

*Primary Examiner*—John P. McIntosh

*Attorney, Agent, or Firm*—Buell, Blenko & Ziesenheim

[57] ABSTRACT

A layer of plastics material is applied to at least one selected surface of a metal article by a method in which the article is heated and positioned in such a way that the selected surface or surfaces is or are lowermost; a table having an upper surface or surfaces carrying a layer of powdered plastics material, said carrier surface or surfaces of the table being of a shape and area such that the surface or surfaces will wholly underlie the selected surface or surfaces of the article, is raised upwardly beneath the article to urge said carrier surface or surfaces against the overlying selected surface or surfaces and so transfer powder from the carrier surface or surfaces to the selected surface or surfaces; and the powdered material adhering to the selected surface or surfaces is permitted or caused to coalesce and form a plastics layer on the or each surface. Preferably powdered plastics material is applied to the carrier surface or surfaces by raising the table upwardly through a fluidized bed of powdered plastics material.

10 Claims, 3 Drawing Figures

Fig.1.

APPARATUS FOR COATING ARTICLES

This is a continuation, division, of application Serial No. 463,580, filed Apr. 24, 1974, now abandoned.

This invention relates to methods of and apparatus for applying to metal articles a coating of plastics material and is particularly concerned with the application of a plastics coating to a selected surface or to each of a number of selected surfaces of an article. The expression "plastics material" includes both thermosetting synthetic resins, for example an epoxy resin, and thermoplastics materials, for example polyvinyl chloride, polythene or other polymer or co-polymer.

According to one aspect of the invention we provide a method for applying a layer of plastics material to the whole or a part of a selected surface or of each of a number of selected surfaces of a metal article which comprises heating the article; positioning the article in such a way that the selected surface or surfaces or the selected part or parts thereof is or are lowermost; raising upwardly beneath the article a table having an upper surface or upper surface carrying a layer of powdered plastics material, said carrier surface or surfaces of the table being of a shape and area such that the surface or surfaces will wholly underlie the selected surface or surfaces or the selected part or parts thereof, and urging said carrier surface or surfaces against the overlying selected surface or surfaces or the selected part or parts thereof to transfer powder from the carrier surface or surfaces of the selected surface or surfaces or the selected part or parts thereof; and permitting or causing the powdered material adhering to the selected surface or surfaces or the selected part or parts thereof to coalesce and form a plastics layer on the or each surface or part thereof.

Where the or each selected surface or selected part thereof of an article is substantially flat the article is preferably so positioned that the or each surface or selected part thereof lies in a substantially horizontal plane and in this case the or each carrier surface of the table will also lie in a substantially horizontal plane.

Powdered plastics material may be applied to the carrier surface or surfaces by any conventional means but it is preferred to position the article above a fluidised bed of powdered plastics material and to raise the table upwardly through the fluidized powdered plastics material so that a layer of powdered plastics material settles on the carrier surface or surfaces for transfer to the selected surface or surfaces or the selected part or parts thereof.

According to another aspect of the invention a layer of plastics material is applied to the whole or a part of at least one selected surface of an article by the method defined above and a layer of plastics material is applied to the whole or a part of one or more than one other selected surface of the article by a method that comprises directing a stream of powdered plastics material on to said other selected surface or surfaces or the selected part or parts thereof of the heated article to cause a layer of powder to adhere to said other surface or surfaces or part or parts thereof, and permitting or causing the powdered material adhering to said other surface or surfaces or part or parts thereof to coalesce to form a plastics layer on the or each surface or part. Where necessary, the article may be re-heated between the two different operations of coating selected surfaces or parts thereof with powdered plastics material.

The invention also includes apparatus for applying a layer of plastics material to the whole or a part of a selected surface or of each of a number of selected surfaces of a metal article by either or both of the methods defined above.

The method of the first aspect of the invention is especially, but not exclusively, suitable for applying a plastics layer to the whole or a part of a surface of a metal article comprising a plurality of lands interposed between and defining a plurality of grooves or slots opening into the surface, and a specific example of an article having an end surface of this form is a stator or a rotor of an alternator comprising a metal annulus having a plurality of circumferentially spaced, longitudinally extending slots.

Where it is required to apply a layer of plastics material to the whole or a part of an end face of a stator or rotor of an alternator the carrier surface of the table preferably has a radial dimension that is substantially equal to or greater than the radial dimension of the lands interposed between and defining the slots of the stator or rotor.

The method of the second aspect of the invention is especially, but not exclusively suitable for applying a plastics layer both to the whole or a part of a surface of a metal article comprising a plurality of lands interposed between and defining a plurality of grooves or slots opening into the surface, and to surfaces bounding each of the grooves or slots, and a stator or rotor of an alternator is a specific example of such a slotted article.

A stator or rotor of an alternator or other article having slots extending throughout its length and opening into end faces of the article will hereinafter, where convenient, be included in the generic expression "slotted article."

Accordingly, the invention also includes a method of applying a layer of plastics material to the whole or parts of selected surfaces of a slotted metal article which comprises heating the article; directing the stream of powdered plastics material into each slot of the article to cause a layer of powder to adhere to those surfaces of the article bounding the slot; positioning the article in such a way that an end face of the article is lowermost; raising upwardly beneath the article a table carrying a layer of powdered plastics material, the table being of a shape and area such that it will wholly underlie at least the lands of the end face interposed between and defining the slots, and urging said table against the overlying lands to transfer powder from the table to the lands; turning the article over so that the other end face of the article is lowermost and repeating the latter coating step; and permitting or causing the powdered material adhering to the surfaces of the article to coalesce to form a plastics layer on each surface.

In a modification of the aforesaid method of applying a layer of plastics to those surfaces bounding a slot of a rotor, stator or other slotted article, a nozzle, through which powdered plastics material can be directed, is positioned adjacent a slot of the article; a divergent stream of powdered plastics material is caused to be ejected from the nozzle; and, at the same time, relative movement is effected between the article and the divergent stream to cause the powdered plastics material to be directed towards those surfaces of the article bounding the slot where it forms a layer of powder which adheres to said surfaces.

The slotted article may be maintained stationary and the nozzle caused to move with respect to the article from one end of the slot to the other. In this case the nozzle is preferably caused to move in a direction opposite to the direction of flow of the divergent stream of powdered plastics material being ejected from the nozzle.

The powdered plastics material may be ejected from the nozzle in a divergent stream by employing a nozzle having an appropriately shaped orifice but it is preferred to associate with the nozzle a separately formed deflector which is of such a shape as to deflect the powdered plastics material transversely with respect to its direction of flow from the nozzle. Where the article is maintained stationary the deflector may be caused to move with the nozzle with respect to the slotted article, or the nozzle may also be maintained stationary and the deflector caused to move with respect to the nozzle.

The aforesaid methods of coating selected surfaces of a slotted article with a plastics material have the important advantages that no masks are necessary to prevent powder adhering to those parts of the article on which a plastics coating is not required, and that substantially uniform distribution of powder on the end faces of the article and on the surfaces bounding each slot can be obtained. Furthermore, because the excess powder carried on the carrier surface or surfaces of the table is of poor thermal conductivity, there is negligible risk that the table might heat up and become fouled by a coating of plastics material.

Each slot may have its boundary surfaces subjected to a stream of powdered plastics material individually or the slots may be subjected to streams of powdered plastics materials sequentially, in groups or simultaneously.

The coating steps of the method of coating selected surfaces of slotted article are preferably carried out in sequence by causing the article to travel automatically along a predetermined path past or through a number of operating stations.

Accordingly, a further aspect of the invention comprises apparatus for applying a layer of plastics material to the whole or parts of selected surfaces of a slotted metal article, which appartus comprises means for heating the article; a station incorporating means for directing a stream of powdered plastics material to the boundary surfaces of the slots of the article; a station incorporating a vertically adjustable table supporting a carrier surface for carrying and applying to the whole or a part of the lowermost end face of the article powdered plastics material; a station incorporating means for turning the article over so that the other of its end faces is lowermost; means for heating the coated article; and means for conveying the article along a predetermined path from the first heating means through said operating stations to the second heating means.

Preferably a station at which powdered plastics material is directed into the slots of a heated slotted article, a station at which the whole or a part of the lowermost end surface of the article is coated, a station at which the article is turned over, a station at which the whole or a part of the other end surface of the article is coated, and a station at which the coated article is removed to heating means may be located at circumferentially spaced positions around a device by which the article is caused to travel around a circular path. An additional station incorporating means for directing powdered plastics material into slots of an article may be interposed between the article-turnoyer station and the second station for coating the whole or a part of an end surface of the article.

The device for causing a slotted article to travel around a circular path through or past the operating stations preferably comprises a turntable having at each of a number of spaced positions around its periphery means for supporting an article and drive means for periodically causing the table to rotate to a sufficient extent to move an article from one station to a succeeding station. The article-support means preferably comprises a pair of jaws for gripping diametrically opposite sides of a slotted article because such jaws do not come into contact with any surface of the article that is to be coated with plastics material. Means may be provided for cooling each article-support means after a slotted article has been removed from it and before another slotted article is fed to it.

Preferred means for directing a stream of powdered plastics material to the boundary surfaces of a slot or slots of a slotted article comprises at least one elongate nozzle; a deflector for deflecting powdered plastics material transversely with respect to its direction of flow from the nozzle; means for supporting an article with an end of one of its slots adjacent the outlet of the nozzle; and means for effecting relative movement between the article and the nozzle in such a direction as to cause the nozzle to pass from one end of the slot to the other.

Preferably, the deflector is mechanically coupled to the nozzle and is adapted to be positioned adjacent the outlet of the nozzle. Preferably, also, the slotted article is maintained stationary and the or each nozzle and its associated deflector is or are supported by means which can be caused to move the nozzle and/or its deflector in the required direction with respect to an article. The nozzle and its associated deflector are preferably mounted on separate support means which can be mechanically coupled together and caused to move in the same direction and which can be coupled so that the nozzle can be maintained stationary or can be caused to move in one direction and its associated deflector caused to move in the opposite direction.

The or each deflector is preferably of elongate form and positioned coaxial with the axis of the nozzle and may comprise a rod which is of substantially uniform cross-section throughout a major part of its length and which tapers to a point at the end of the rod that will be nearer the outlet of the nozzle.

The invention is further illustrated by a description, by way of example, of preferred apparatus for coating selected surfaces of a stator by the method of the invention with reference to the accompanying drawings, in which.

Figure 1:
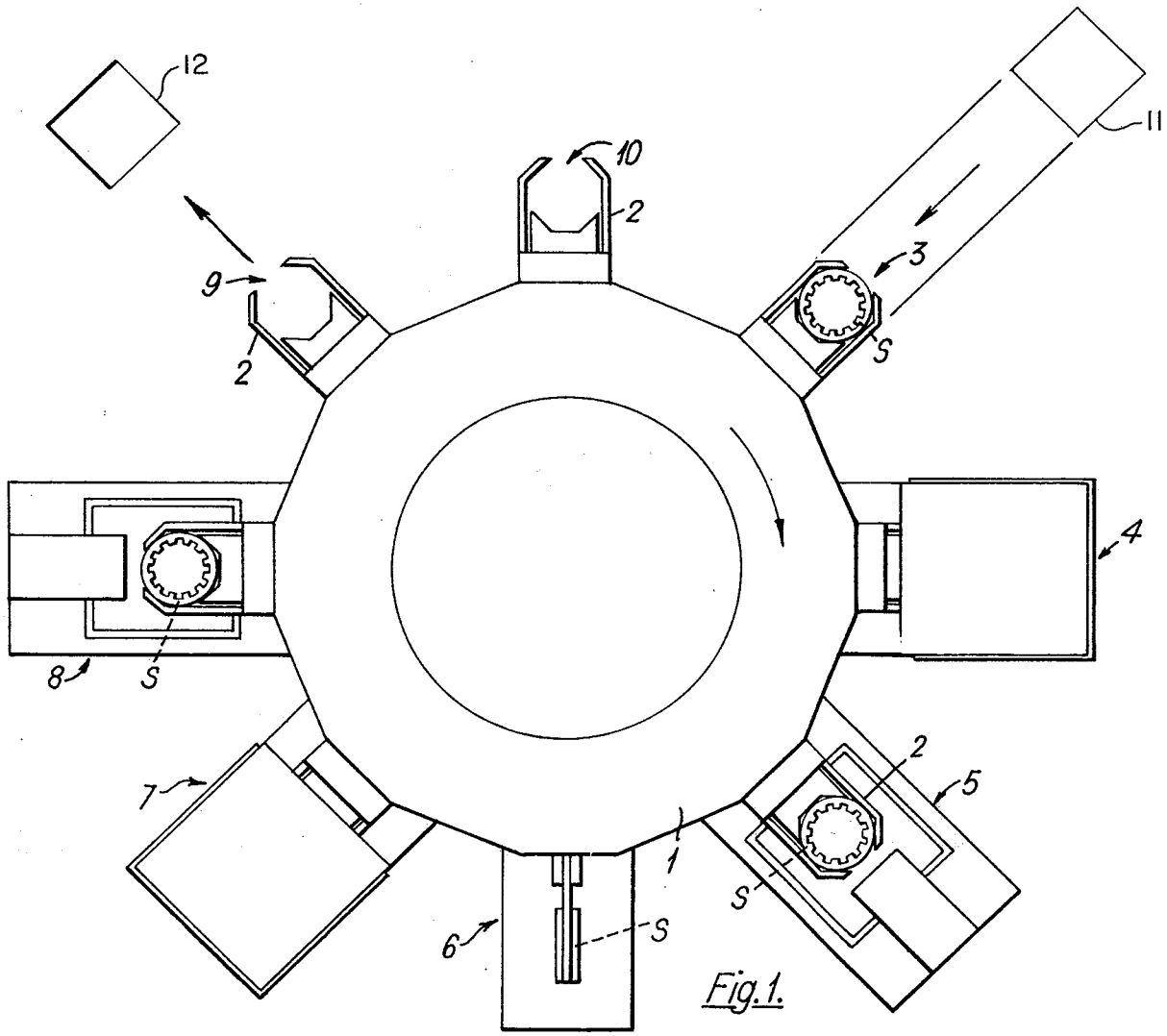
FIG. 1 is a diagrammatic plan view of the general assembly of the apparatus.

Referring to FIG. 1, the apparatus comprises a rotatably driven turntable 1 which carries at each of eight positions around its periphery a pair of pneumatically operated jaws 2 for gripping a stator, to selected surfaces of which a layer of plastics material is to be applied. The turntable 1 is adapted to rotate at periodic intervals and to a sufficient extent to cause a pair of jaws 2 to move from one to eight operating stations positioned at spaced locations around the turntable to a succeeding operating station.

The operating stations comprise a loading station 3 at which a stator is received into a pair of jaws 2 from a pre-heating oven for stators 11, shown schematically; a slot-coating station 4 at which streams of powdered plastics material are directed into slots of a stator at the station, powder not adhering to the surfaces bounding the slots falling downwardly through the slots where it is collected in a suitable receptacle; an end face-coating station 5 where a layer of powdered plastics material is applied to one end face of a stator at the station; a station 6 at which a pair of jaws 2 at the station are rotated about a radially extending axis to turn the stator supported in the jaws through 180°; a second end face-coating station 8 of similar construction to station 5, where a layer of powdered plastics material is applied to the other end face of a stator; an unloading station 9 where a stator is removed from a pair of jaws at this station and is conveyed to a heating oven 12 shown schematically for coated stators where the powdered material adhering to the selected surfaces of each stator is caused to coalesce and form a plastics layer on each surface; and a station 10 at which a pair of jaws 2 is cooled before it is moved to the loading station 3. A second slot-coating station 7 may be provided between stations 6 and 8 if found necessary.

Loading and unloading of stators at stations 3 and 9 is entirely automatic so that no manual handling of hot or coated stators takes place. The device (not shown) by which a stator is loaded into a pair of jaws 2 at station 3 also orientates the stator so that the slots are in a fixed angular position appropriate for the introduction of powdered plastics material at the slot-coating station 4 and the slot-coating station 7, when present.

Figure 2:
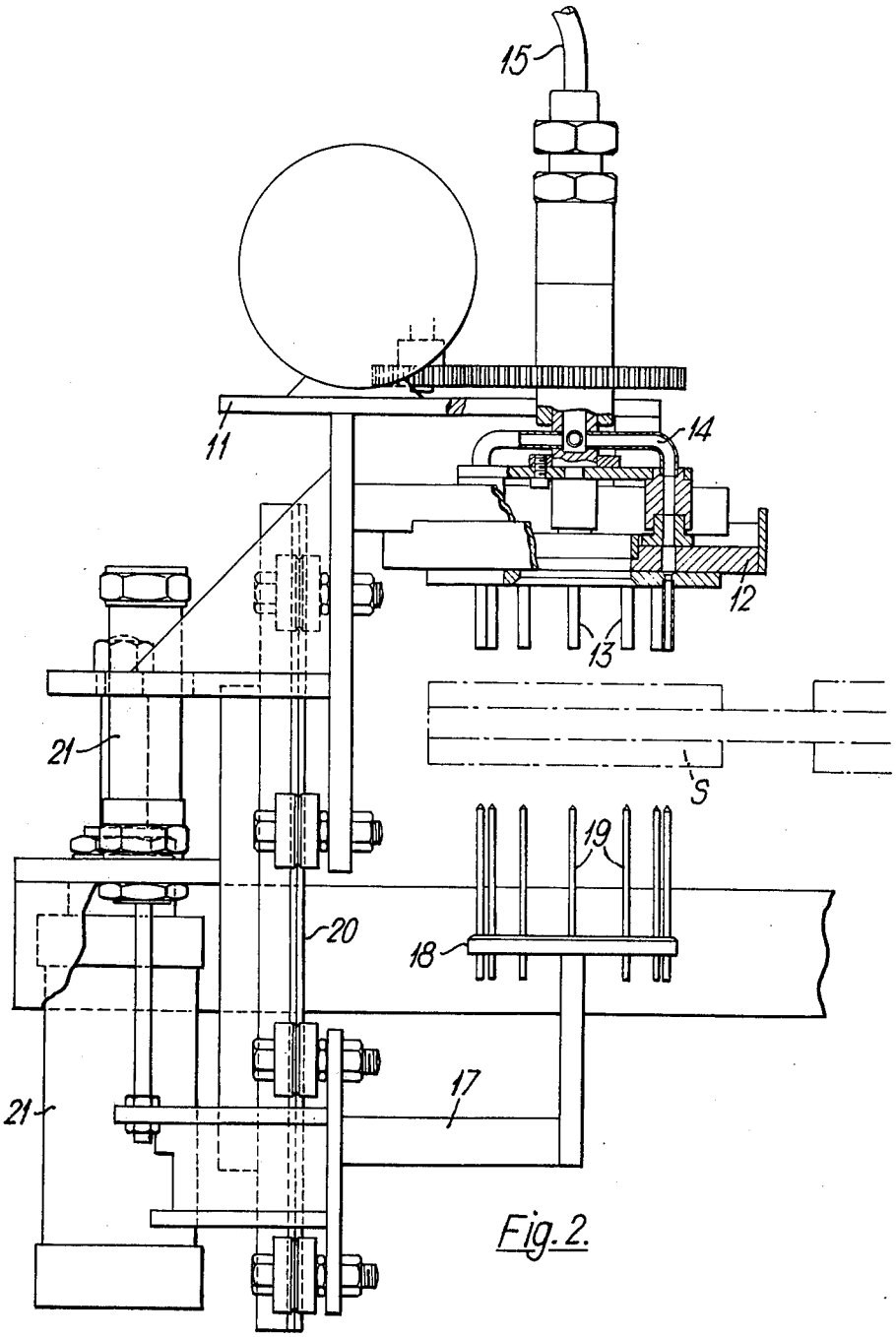
FIG. 2 is a side elevation of apparatus for coating with powdered plastics material the surfaces bounding the slots of the stator.

The slot-coating station 4 (FIG. 2) comprises a support structure 11 from which depends a nozzle plate 12 supporting a plurality of elongate nozzles 13. Each of the nozzles 13 is fed with a stream of air carrying powdered plastics material through a pipe 15 and rotatable distributor 14. Mechanically coupled to the support frame 11 is a second support frame 17 which supports an annular ring 18 on which are mounted a plurality of pointed deflector rods 19, each deflector rod being coaxial with a nozzle 13 with its pointed end nearer the nozzle. Support frames 11 and 17 are mounted on a linear slide 20 and can be caused to move towards or away from one another by pneumatic cylinders 21.

Figure 3:
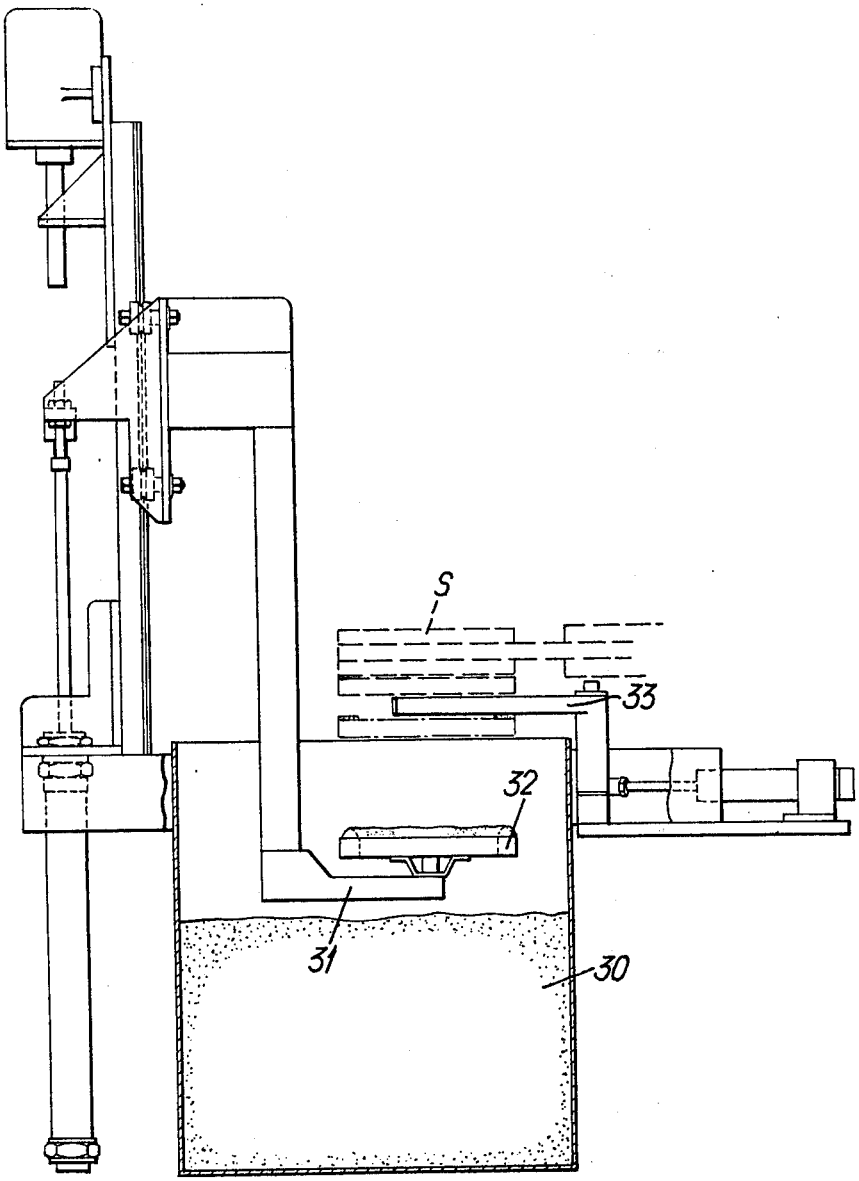
FIG. 3 is a side elevation of apparatus for coating with powdered plastics material an end surface of the stator.

At each end face-coating station 5 and 8 (FIG. 3) is a fluidized bed 30 of powdered plastics material and a vertically adjustable table 31 supporting a substantially horizontal ring 32, of a radius and area such that it will wholly underlie the lands of an end face of the stator interposed between and defining the slots. Associated with the table 31 is a substantially horizontal arm 33 that can be caused to traverse above the upper surface of the ring to wipe surplus powdered plastics material from the ring and to provide an even layer of powder on it.

In operation, a stator S is fed from a pre-heating oven to the loading station 3 where the stator is gripped by a pair of jaws 2 at the station in such a way that its end faces are substantially horizontal and the slots of the stator are appropriately angularly positioned for subsequent introduction of powdered plastics material. The turntable 1 is then automatically rotated to a sufficient extent to move the pair of jaws carrying the stator S to the slot-coating station 4. At station 4 the stator S is positioned between the nozzles 13 and deflector rods 19 (FIG. 2), and the nozzles and deflector rods are caused to move towards one another until the outlets of the nozzles are substantially in alignment with the uppermost end face of the stator and adjacent the uppermost ends of the slots and the pointed ends of the deflector rods are spaced a short distance from the nozzle outlets. The powdered plastics material is then caused to be directed through the nozzles 13 and, at the same time, the nozzles and deflector rods 19 are together caused to move downwards through the slots, powdered plastics material emitted from the nozzles being deflected by the deflector rods on to the surfaces bounding the slots. Powder not adhering to these surfaces falls downwards through the slots and is collected in a suitable receptacle.

After the surfaces bounding the slots of the stator S have been so coated the nozzles 13 and deflector rods 19 are caused to separate until each is clear of the stator and the turntable 1 is then rotated until the pair of jaws carrying the stator are moved to the end face-coating station 5. At station 5 the ring 32 mounted on the vertically adjustable table 31 is caused to move vertically upwards through the fluidized bed 30 of powdered plastics material and as the ring emerges from the fluidized bed it is stopped and the horizontal arm 33 is caused to traverse through the powder carried by the upper surface of the ring to wipe excess powder from the ring and so ensure that an even layer of powder remains on the ring. The powder-carrying ring 32 is then caused to travel upwards to urge the surface carrying the powder against the overlying end face of the stator S to transfer powder from the ring to the end face. The table 31 is then adjusted to move the ring 32 back into the fluidized bed 30. The turntable 31 is again rotated to move the pair of jaws 2 carrying the stator S to station 6 where the pair of jaws is rotated through 180° about an axis radial to the turntable, so that the end face of the stator that was uppermost is now lowermost.

The turntable 1 now rotates to a sufficient extent to move the pair of jaws 2 carrying the stator S to station 8, where the end face of the stator that is now lowermost is coatd with a layer of powder in the same way that employed at station 5. After the lowermost end face of the stator S has been so coated, the turntable 1 is rotated to a sufficient extent to cause the pair of jaws 2 carrying the stator to move to the unloading station 9, where the stator with its selected surfaces now coated with powder is removed from the pair of jaws and is automatically conveying to a heating oven where the powdered plastics material adhering to the selected surfaces is caused to coalesce and form a plastics layer on each surface. After the pair of jaws 2 has been unloaded the turntable 1 is again rotated to move the pair of jaws to station 10, where the pair of jaws are cooled by streams of cold air prior to moving them to station 3 for re-loading with a stator.

The apparatus can be readily modified for coating with powdered plastics material selected surfaces of rotors by appropriate adjustment of the nozzles and the provision of a ring on the vertically adjustable table that is of an area and shape appropriate to the end faces of the rotors.

This preferred apparatus of the present invention for coating selected surfaces of rotors or stators has the very important advantage that powdered plastics material can be appied to selected surfaces of three, or four, separate rotors or stators simultaneously.

What I claim as my invention is:

1. Apparatus for applying a layer of plastics material to selected surfaces of a metal article which article has slots extending throughout its length and opening into first and second end faces of the article, which apparatus comprises means for a first heating of the article, a plurality of operating stations located at circumferentially spaced locations around a circular path, which operating stations comprise a slot-coating station providing means for directing a stream of powdered plastics material to slot defining surfaces of said slots of the article, an end coating station including a vertically adjustable table having a carrier surface for carrying and applying powdered plastics material to at least a part of a downward facing first end face to the article, a turning station incorporating means for turning the article over so that the second end face is downward facing, a second end coating station incorporating a vertically adjustable table having a carrier surface for carrying and applying powdered plastics material to at least a part of the second end face of the article, means for a second heating of the article to coalesce the plastics material and form a coating on each selected surface of the article, means for conveying the article through the several operating stations to enable the coating of the surfaces defining the slots and both end faces of the article for delivery to the means for second heating, and article support means on said means for conveying for receiving the article from said means for first heating, onto said means for conveying, the stations being arranged around the circular path in any order, provided that the turning station is encountered between the two end coating stations on passing around the circular path.

2. Apparatus as claimed in claim 1, wherein the means for conveying comprises a turntable having said article support means at each of a number of spaced positions around its periphery means for supporting an article, and drive means for periodically causing the table to rotate to a sufficient extent to move an article from one station to a succeeding station.

3. Apparatus as claimed in claim 2, wherein the article-support means comprises a pair of jaws for gripping automatically opposite sides of a slotted article.

4. Apparatus as claimed in claim 2, wherein the station is provided for the cooling of each article-support means after a slotted article has been removed from it and before another slotted article is fed to it.

5. Apparatus as claimed in claim 1, wherein second slot-coating station incorporating means for directing powdered plastics material into slots of an article is interposed between the article-turnover station and the second station for coating an end face of the article.

6. Apparatus as claimed in claim 1, wherein said means for directing a stream of powdered plastics material to the slot defining surfaces of the slots of the article comprises a plurality of elongate nozzles, one for association with each slot of a slotted article, for directing a stream of powdered plastics material into the slot; a plurality of deflectors, one associated with each nozzle, for deflecting powdered plastics material out of the stream from that nozzle onto slot defining surfaces of the heated article, means for supporting an article with an end of each of its slots adjacent the outlet of its associated nozzle; and means for effecting relative movement between an article and the deflectors in such a direction as to cause deflectors to pass along the slots.

7. Apparatus as claimed in claim 1, wherein said means for directing a stream of powdered plastics material to the boundary surfaces of the slots of the article comprises a plurality of elongate nozzles, one associated with each slot of a slotted article, for directing a stream of powdered plastics material into the slot; a plurality of deflectors, one associated with each nozzle, for deflecting powdered plastics material transversely with respect to its direction of flow from each nozzle, each deflector being mechanically coupled to, and adapted to be positioned adjacent the outlet of, its associated nozzle; means for supporting an article with an end of each of its slots adjacent the outlet of its associated nozzle; and means for effecting relative movement between an article and the nozzles and their associated deflectors in such a direction as to cause the nozzles and deflectors to pass from one end of the slots to the other.

8. Apparatus as claimed in claim 7, wherein the nozzles of their associated deflectors are supported by means which can be caused to move the nozzles and their deflectors in the required direction with respect to an article.

9. Apparatus as claimed in claim 7, wherein each nozzle and its associated deflector are mounted on separate support means which can be mechanically coupled together and caused to move in the same direction and which can be uncoupled so that the nozzle can be caused to move in one direction and its associated deflector caused to move in the opposite direction.

10. Apparatus as claimed in claim 7, wherein each deflector is of elongate form, is positioned coaxially with the axis of its associated nozzle and comprises a rod which is of substantially uniform cross-section throughout the major part of its length and which tapers to a point at the end of the rod nearer the outlet of the nozzle.

* * * * *

UNITED STATES PATENT OFFICE

CERTIFICATE OF CORRECTION

Patent No. 4,036,169 Dated July 19, 1977

Inventor(s) PETER HARVEY

It is certified that error appears in the above-identified patent and that said Letters Patent are hereby corrected as shown below:

Column 1, line 1, after "a" delete --continuation--; same line, after "division" delete the comma.

Column 1, line 16, "for" should read --of--.

Column 1, line 23, "surface" second occurrence, should read --surfaces--.

Column 1, line 31, "of" should read --to--.

Column 1, line 44, "conventional" should read --convenient--.

Column 2, line 39, "the" second occurrence, should read --a--.

Column 3, line 34, after "of" insert --a--.

Column 3, line 66, "article-turnoyer" should read --article-turnover--.

Column 4, line 37, "coupled" should read --uncoupled--.

Column 4, line 68, "to" second occurrence, should read --of--.

Column 6, line 42, "coatd" should read --coated--; same line, after "way" insert --as--.

Column 6, line 49, "conveying" should read --conveyed--.

Column 6, line 66, "appied" should read --applied--.

Column 7, claim 1, line 14, "to" should read --of--.

UNITED STATES PATENT OFFICE

CERTIFICATE OF CORRECTION

Patent No. 4,036,169 Dated July 19, 1977

Inventor(s) PETER HARVEY

It is certified that error appears in the above-identified patent and that said Letters Patent are hereby corrected as shown below:

Column 7, claim 3, line 42, "automatically" should read --diametrically--.

Column 7, claim 4, line 43, "the" should read --a--.

Column 8, claim 8, line 33, "of" should read --and--.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*